United States Patent [19]

Comerford et al.

[11] Patent Number: 4,999,606

[45] Date of Patent: Mar. 12, 1991

[54] DIVE PARAMETER INDICATING ASSEMBLY

[75] Inventors: Ernest Comerford, 41 Moresby Street, Trinity Beach, Queensland 4871; Michael Adamek, Magnetic Island, both of Australia

[73] Assignee: Ernest Comerford, Queensland, Australia

[21] Appl. No.: 543,476

[22] Filed: Jun. 25, 1990

Related U.S. Application Data

[63] Continuation of Ser. No. 283,993, filed as PCT AU88/00055 on Mar. 3, 1988, published as WO88/06549 Sep. 7, 1988, Pat. No. 4,949,072.

[30] Foreign Application Priority Data

Mar. 3, 1987 [AU] Australia ..... PI0633

[51] Int. Cl.[5] ..... G08B 25/00; H04B 11/00

[52] U.S. Cl. ..... 340/525; 340/870.16; 340/705; 340/573; 340/850; 73/865.1; 73/866.3; 2/2.1 R; 2/173; 367/134; 367/910; 364/413.31; 128/201.19; 128/201.27; 375/6

[58] Field of Search ..... 340/525, 796, 705, 850, 340/531, 573, 870.01, 870.09, 870.1, 870.16; 73/865.1, 300, 866.3, 299, 301; 2/2.1 R, 173; 455/40; 375/6; 367/131-134, 141, 910; 441/105, 124; 128/201.19, 201.27, 202.11, 202.22, 205.23; 364/413.31

[56] References Cited

U.S. PATENT DOCUMENTS

| | | | |
|---|---|---|---|
| 3,712,714 | 1/1973 | Uyeda et al. | 340/705 |
| 3,784,805 | 1/1974 | Rolle | 367/903 |
| 3,992,948 | 11/1976 | D'Antonio et al. | 73/865.1 |
| 4,480,323 | 10/1984 | Page | 367/131 |
| 4,550,984 | 11/1985 | Reymond | 340/980 |
| 4,563,758 | 1/1986 | Paternostro | 367/134 |
| 4,679,177 | 7/1987 | Aoyagi et al. | 367/134 |
| 4,776,045 | 10/1988 | Mysliwiec et al. | 2/2.1 R |

*Primary Examiner*—Donnie L. Crosland
*Attorney, Agent, or Firm*—Helfgott & Karas

[57] ABSTRACT

A dive parameter transmitter/receiver assembly for scuba diving includes a transmitter circuit with a control unit with one or more sensors for detecting dive parameters and/or information to be displayed. A modulator is included for modulating the parameter(s) or information and a transmitting transducer for propagating the parameter(s) or information. A receiver circuit is included and has a receiver transducer a demodulator, a decoder and a display for displaying the parameter(s) or information.

29 Claims, 7 Drawing Sheets

DIVE PARAMETER INDICATING ASSEMBLY

This is a continuation of application Ser. No. 283,993, filed as PCT AU88/00055 on Mar. 3, 1988, published as WO88/06549 Sep. 7, 1988 now U.S. Pat. No. 4,949,072.

This invention relates to a dive parameter indicating assembly for scuba diving.

Scuba diving is an exacting sport and because of a a variety of potential hazards which may present themselves, numerous parameters must constantly be monitored by the diver to avoid mishap. For sports diving maximum diving depth is generally limited to not greater than 30 meters. Dives of greater depth are also preformed but are generally not within the realms of sports diving.

The duration of the bottom time for a dive is governed by numerous factors including amount of compressed air available for the dive, the depth of the dive and whether or not the dive is a repetitive one. The diver needs to be aware of numerous parameters to make his dive safe and enjoyable. Parameters such as the actual time of day, depth, water temperature, elapsed or bottom time and air pressure within a tank need to be monitored. Air pressure is indicative of the amount of air in the diver's tank. In addition to this, it is useful to keep track of surface interval duration between dives as this enables a calculation to be made of the total bottom time for a subsequent or repetitive dive to ensure that that dive is a non-decompression dive if indeed a non-decompression dive is required.

Often dives are such that if the bottom time for a non-decompressin dive is exceeded one or more decompression stops at one or more depths need to be made during ascent to avoid the condition known as "the bends". Decompression stop duration is governed by the length of time a diver overstays at a depth beyond the duration which would result in the dive being a non-decompression dive. Thus a diver must be able to time decompression stops.

Currently, divers utilize a variety of instruments and gauges to enable the various parameters to be monitored. In one instance a gauge console connected via a high pressure line to the regulator first stage is used. Such consoles typically carry a pressure gauge for determining tank pressure, a depth gauge with or without a maximum depth indicator (MDI), a compass for navigation and a thermometer. The gauges may either be analogue or digital in nature. Analogue gauges are usually fluid filled. Analogue depth gauges sometimes include an MDI which regulates the maximum depth of a dive and this must be zeroed for subsequent dives. Digital gauges sometimes include computers for calculating the divers group designation either for a first dive or a repetitive dive and may be preprogrammed with dive tables to provide an indication of maximum dive duration or adjusted duration at certain depths.

Such consoles, as mentioned, were tethered to the regulator first stage and sometimes proved difficult to retrieve for viewing during a dive. In addition there was always the danger that the console and or hose may become entangled or snared on objector the like during a dive. Consoles were prone to damage as other diver's gear was sometimes inadvertently dropped on them. Also, all the gauges were generally not on one side of the console and the console needed to be manipulated and turned to enable the gauges to be viewed. Consoles did not provide for "hands free" use.

Other gauges were sometimes worn like wrist watches on either one or both wrists. These would sometimes become dislodged particularly when wet suit material became compressed at depth and once again did not provide for "hands free" viewing. Such gauges did not display all parameters of interest to a diver and did not for example provide an indication of remaining air.

A divers mask is chosen with numerous characteristics in mind. The mask must be comfortable, provide a reasonable degree of vision and should provide a small as possible air space between the diver's face and the mask. If an unnecessarily large space is present it becomes difficult for the diver to equalise pressure in air spaces in his body during descent and ascent.

It is an object to provide a dive parameter indicating assembly for use in scuba diving.

The display may be integral with or attachable to a diver's face mask or may be located remote from the mask. Preferably the display is integral or attachable to the face plate of the mask. The display may not be physically coupled to the remainder of the assembly and in which case signals from the control unit may be transmitted to the display. Transmission may be by radio frequency, ultrasound or any other suitable transmission method.

The display is preferably a visual one and may include audible signals or alarms if desired. The display may be a light emitting diode (LED) display or a liquid crystal display (LCD). The display may function to cycle through a plurality of parameters and display each in turn or alternatively the display of a particular parameter may be effected by the diver or a combination of both of these features may be provided. Alternatively, separate displays may be used for each parameter. Where the display is separate from the control unit it may include receiving means for receiving and processing signals transmitted by the control unit and driving circuitry for driving the display. When the display is physically coupled to the control unit the driving circuitry may be present in the unit. Where one of the parameters is air pressure i the scuba tank, a high pressure hose may be coupled to the asesmbly, either to the mask itself (where the display is physically coupled to the control unit) or to the control unit.

The display may show the parameters in alpha numeric form or in the form of bar scales or in any other suitable way. Since the mask has a face plate which is particularly close to the diver's eyes, difficulty may be experienced in focusing down to such a short distance. In which case an imaging system may be employed to overcome this problem. One imaging system which may be used employs one or more lenses associated with the display to present the information provided by the display in a more easily focused optical position.

In addition to the display, the mask may have associated with it a ranging system useful when diving in water presenting poor visibility. The ranging system may employ ultrasonic infra-red or radar ranging and may provide either a visual and/or audible alarm when the diver is within a preset distance of an object. Preferably it is possible to adjust the preset distance at which an alarm may occur.

The control unit may include sensors, a timer and clock ranging circuitry and a memory and computer.

The sensors may be responsive to water temperature, air tank pressure, depth or other conditions to enable the control unit to provide a representative signal for the display. Any suitable sensors may be used for this purpose. One of the sensors may for example, be responsive to ambient light intensity to enable the control unit to provide a signal which may be representative to light readings for the taking of photographs.

The depth sensor may not only indicate the particular depth at which a diver may find himself from time to time but may also enable the memory of the control unit to record the maximum depth attained by the diver in that dive. This reading may be used later to determine the diver's group destination for repetitive dives. The sensors may be mounted to the mask or be located at any other convenient site. The timer and clock may enable the display of the actual time of day, the actual bottom time of a dive and in conjunction with the control unit may enable that unit to provide a signal representative of an adjusted bottom time for a repetitive dive taking into account residual nitrogen times. The timer and clock may also be employed to time out a surface interval duration or to record a surface interval duration to either enable the diver to achieve a particular new group designation or to enable the diver to calculate his new group designation.

The memory may comprise a read only memory (ROM) and a random access memory (RAM) to not only enable the storage of information relating to dive tables but to also enable ancillary calculations to be carried out or to store information such as surface interval duration between dives, bottom time water temperature and depth attained in a dive for example.

The assembly of the invention may be powered in any convenient way. Where the display is physically coupled to the remainder of the assembly one power source such as a battery may be used. Where the display is not coupled in this way separate power sources may be provided for the display and the remainder of the assembly.

The control unit may provide an alarm when the maximum or adjusted bottom time for a particular depth is exceeded or about to be exceeded and thus the need for decompression staging may be avoided. In addition, where decompressin stops are required the assembly of the invention may be used to determine and time the stop or stops. The duration of the stops may be determined from the memory in the control unit.

It will be appreciated that the assembly of the invention will enable the diver to have both hands free and still be able to monitor vital parameters. In addition dive bottom time and maximum depth may be automatically stored to enable either a manual determination of group designation or an automatice determination of group designation to be made without the need for reference to dive tables.

The invention will be described by way of example with reference to the drawings in which.

Figure 1:
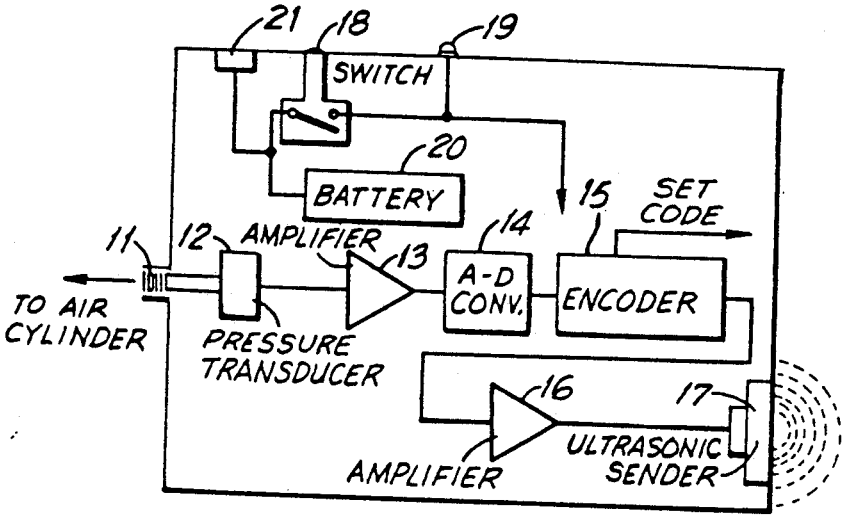
FIG. 1 is a block diagram of an air pressure transducer transmitter circuit.

FIG. 1 of the drawings shows a block diagram of an air pressure transducer/transmitter circuit 10 for determinging the air pressure in the cylinder or tank of compressed air or other gas breathing mix and hence the quantity of the air or mix within the tank. Connector 11 is coupled either directly or indirectly to the tank or the first stage or high pressure stage of an air pressure regulator. Pressure transducer 12 is responsive to the air pressure present in the tank to provide an electrical analogue of the actual tank pressure. Transducer 12 may be a Dowty Controls transducer LS 416/2 or equivalent. Amplifier 13 receives the output from transducer 12 and suitably amplifies the signal and provides that amplified signal to analogue to digitial (A/D) converter 14. A/D converter 14 produces a coded output representative of the analogue input provided by amplifier 13. The coded ouput is supplied to an encoder 15 which provides a coded output suitable for driving an ultransonic transducer. Encoder 15 supplies its coded output to an amplifier 16 which in turn drives an ultrasonic sender 17. Thus the pressure sensed by transducer 12 is converted ultimately to an ultrasonic signal by sender 17. This signal may be detected remote from circuit 10 and utilized to provide a remote indication of tank pressure without a physical connection between the tank and the location at which the remote indication is provided.

As shown in FIG. 1 the circuit 10 has an ON/OFF switch 18, a status indicator 19 such as a light emitting diode (LED) and a rechargeable battery pack 20. A charging socket 21 is present and enables periodic battery charging.

Figure 6:
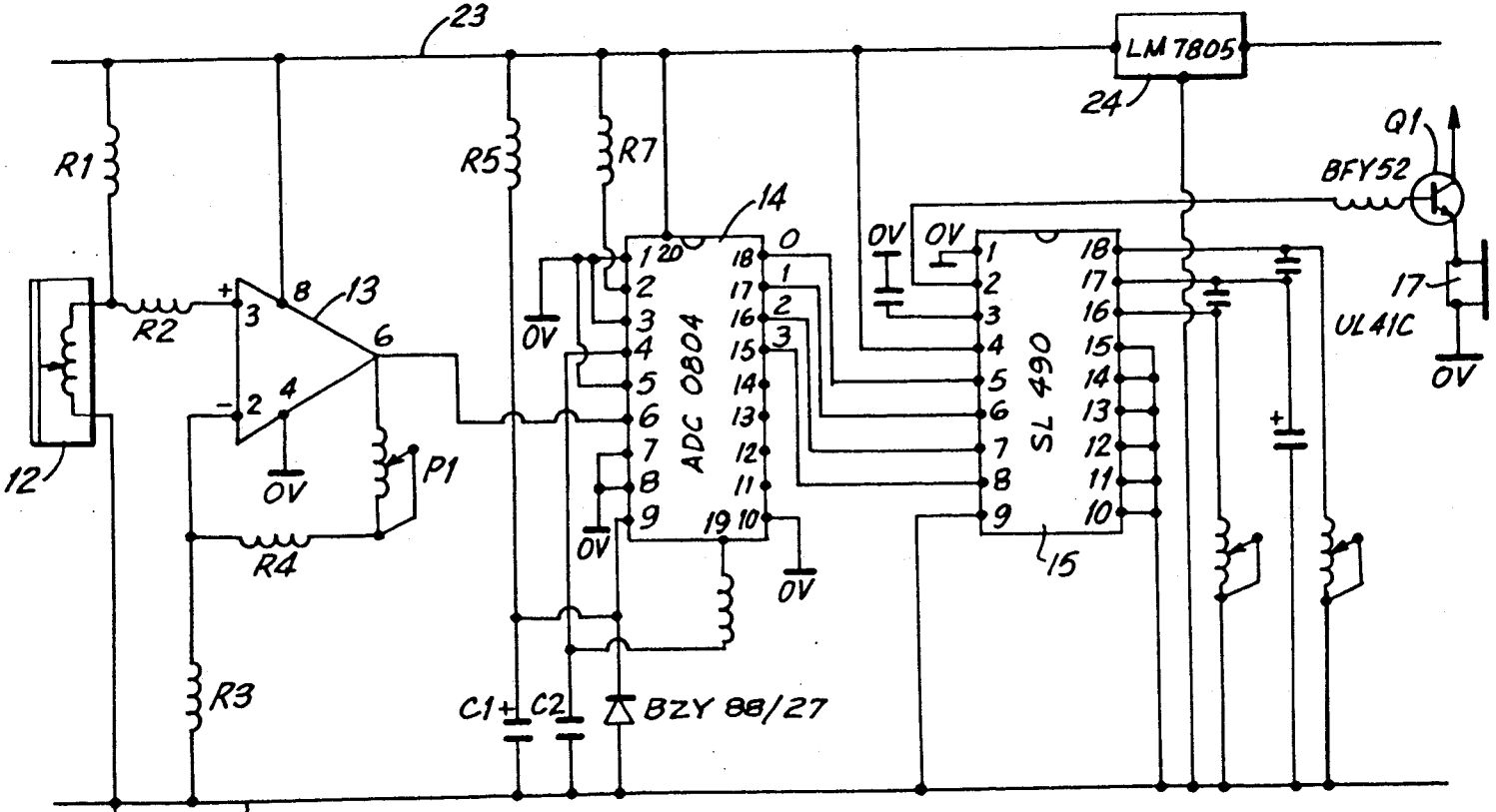
FIG. 6 is a detailed circuit diagram of part of the circuit of FIG. 1 of the drawings.

FIG. 6 of the drawing shows details of the block diagram circuit of FIG. 1. The transducer 12 is coupled between resistor R1 and an earth or reference rail 22. Resistor R1 and series connected resistor R2 enable the output from transducer 12 to be directed to the non-inverting input of amplifier 13. Amplifier 13 is an integrated circuit amplifier and device CA3140F or equivalent or substitute may be employed. Resister R3 is coupled to extend between the inverting input of amplifier 13 and that resister together with resistors R4 ane P1 enable the gain of the amplifier 13 to be adjusted to compensate for the desired scale of signal provided at the output of the amplifier. Filter components consisting of series connected resistor R5 and electrolytic capacitor C1 are coupled to extend between the supply rail 23 and the reference rail 22. Analogue to digital convertor 14 is coupled to the rails 22 and 23 and receives as its input the output of amplifier 13. Filter and biassing components C2, R6 and R7 are coupled as indicated to the convertor 14. A voltage reference signal is provided by zenner diode Z1. The analogue to digital convertor 14 may be an ADC0804 device or equivalent whilst the zenner diode Z1 may be a 2.7 volt diode identified by the component no. BZY88. Not all of the outputs of the convertor 14 are used. Four of these outputs provide the input signals for encoder 15.

The output from encoder is available at the location identified by the letter A. Various biassing and filter components are coupled to the encoder as illustrated in the figure. The output A is made available as an input signal to the base of amplifier Q1. This signal is supplied to the base electrode of Q1 via resistor R8. The collector electrode of amplifier Q1 is coupled to the unregulated supply whilst ultrasonic transducer 17 extends between the emitter electrode of amplifier Q1 and the reference rail 22. The unregulated voltage of 10 to 16 volts obtained from battery pack 20 is coupled to integrated circuit voltage regulator 24. Regulator 24 may be device type LM7805 and provides a regulated 5 volt output on supply rail 23.

Figure 3:
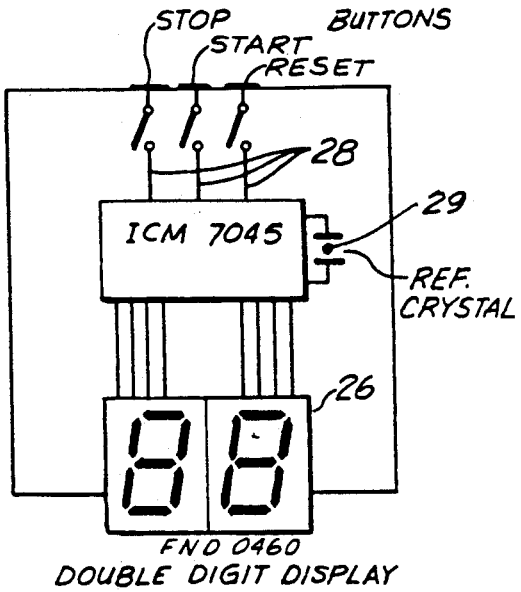
FIG. 3 is a block diagram of a known tiimer/stop watch circuit.

FIG. 3 of the drawings is a block diagram circuit of a known timer/stop watch 25 this block diagram illustrates a display 26 which in this case is a double digit display device number FND0460. The display is capable of displaying elapsed time in minutes in the form of a two digit seven segment display code. The display is driven by commercially available counter timer integrated circuit 27. The timer 27 has control inputs 28 to effect stop/start and reset. The reference for the timer 27 is provided by crystal 29. The display 26 is either secured to or forms an integral part of the diver's mask or alternatively may be worn on the diver's wrist. The timer starts its timing function at the beginning of a dive and at a preset time operates to provide an audible alarm. The elapsed time from the commencement of the dive is displayed by display 26.

Figure 4:
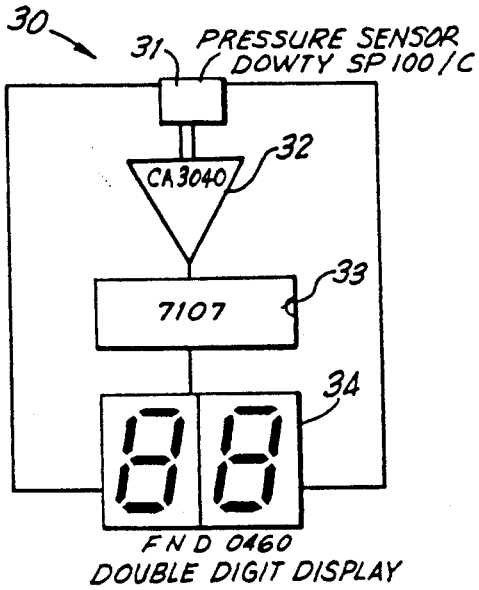
FIG. 4 is a block diagram of a depth gauge circuit.

FIG. 4 of the drawings shows a block diagram circuit of an embodiment of a depth gauge 30. The depth gauge includes a pressure sensor 31 which may be a Dowty device number SP100/C. The pressure sensor 31 provides an input to amplifier 32. Amplifier 32 provides at its output an input signal for digital to analogue convertor 33. Convertor 33 may be Intersil device ICL7107 which is a three and half digit converter and includes seven segment decoder and driver and functions to provide suitable outputs for display 34. Display 34 may be indentical to display 26 in FIG. 3 of the drawings. Display 34 may be either integral with the diver's mask or be secured thereto or may alternatively be worn on the diver's wrist. Pressure at sea level is one atmosphere and pressure constantly increases a further one atmosphere for every 10 meters increase in depth below the surface. Thus, the presure at any given depth is directly proportional to distance below the surface. The sensor may adjustable to correctly read depth for water or varying salinity or for fresh water.

Figure 2:
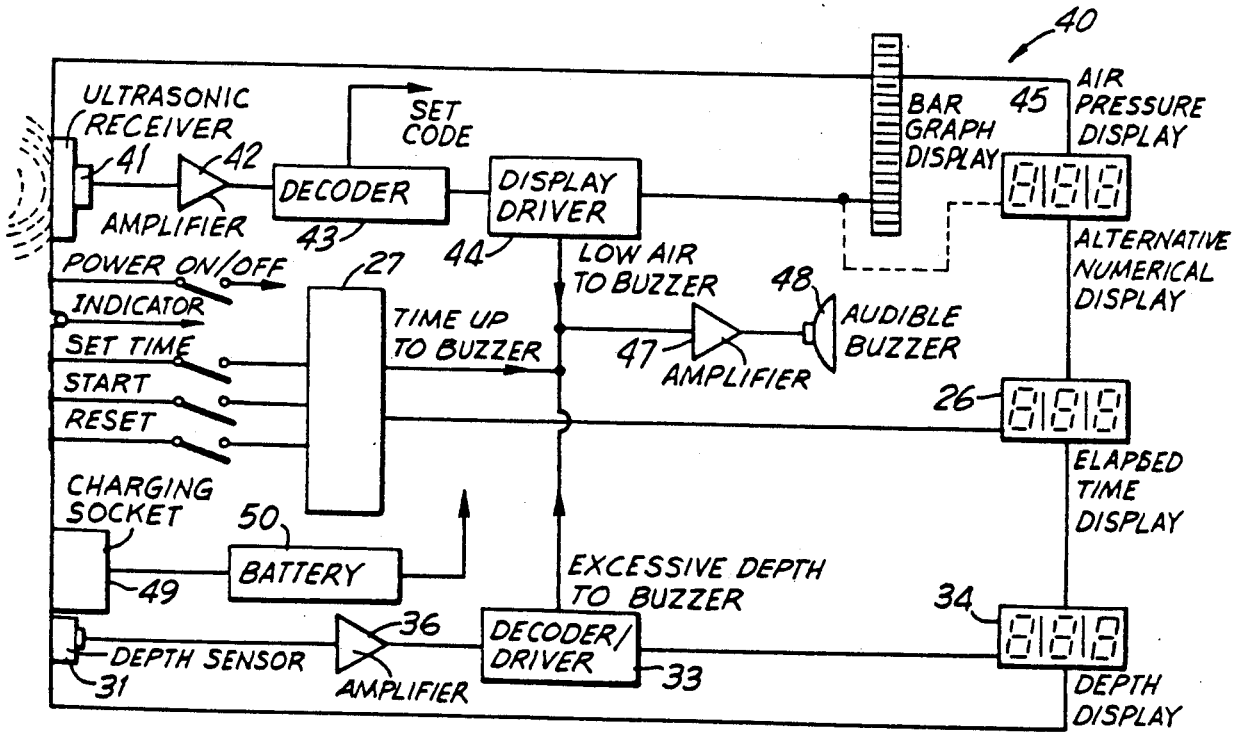
FIG. 2 is a block diagram of a display receiver circuit.

FIG. 2 is a block digram of a display receiver circuit. The circuit 40 includes an ultrasonic receiver 41 for receiving the ultrasonic signal provided by transducer 17 in FIG. 6. The output signal of ultrasonic reciever 41 is amplified by amplifier 42 and provided as an input to decoder 43. Decoder 43 provides an input for display driver 44. The driver 44 provides two outputs. One of these outputs is used to provide a visual indication of the pressure within the tank or cylinder. The visual indication may be provided by a display 45 which provides a numerical or digital indication of the pressure within the tank. In this embodiment, display 45 is a three digit seven segment display. Alternatively, the tank pressure may be displayed by a bar graph display 46. Regardless of which type of visual display is used, the display is made either integral with the diver's mask or attachable thereto so as to be readily visible by the diver when he wears that mask. The second output provided by the driver 44 may be used to provide an audible alarm whenever the tank pressure falls below a predetermined minimum pressure. This output, as shown is supplied to amplifier 47 and amplifier 47 operates an audible buzzer 48.

The timer/stop watch 25 of FIG. 3 is also shown in this block diagram. In this embodiment, integrated circuit 27 provides two outputs, one of which is used to drive display 26' and the other of which is coupled to the input of amplifier 47. In this way, the display 26' displays elapsed dive time and circuit 27, may provide an alarm signal once a predetermined dive time has been reached.

The circuit of FIG. 2 also includes a rechargeable battery pack which supplies or provides power for the various components of the circuit. The battery pack 50 is coupled to a charging socket 49 for facilitating recharging of the pack.

Figure 5:
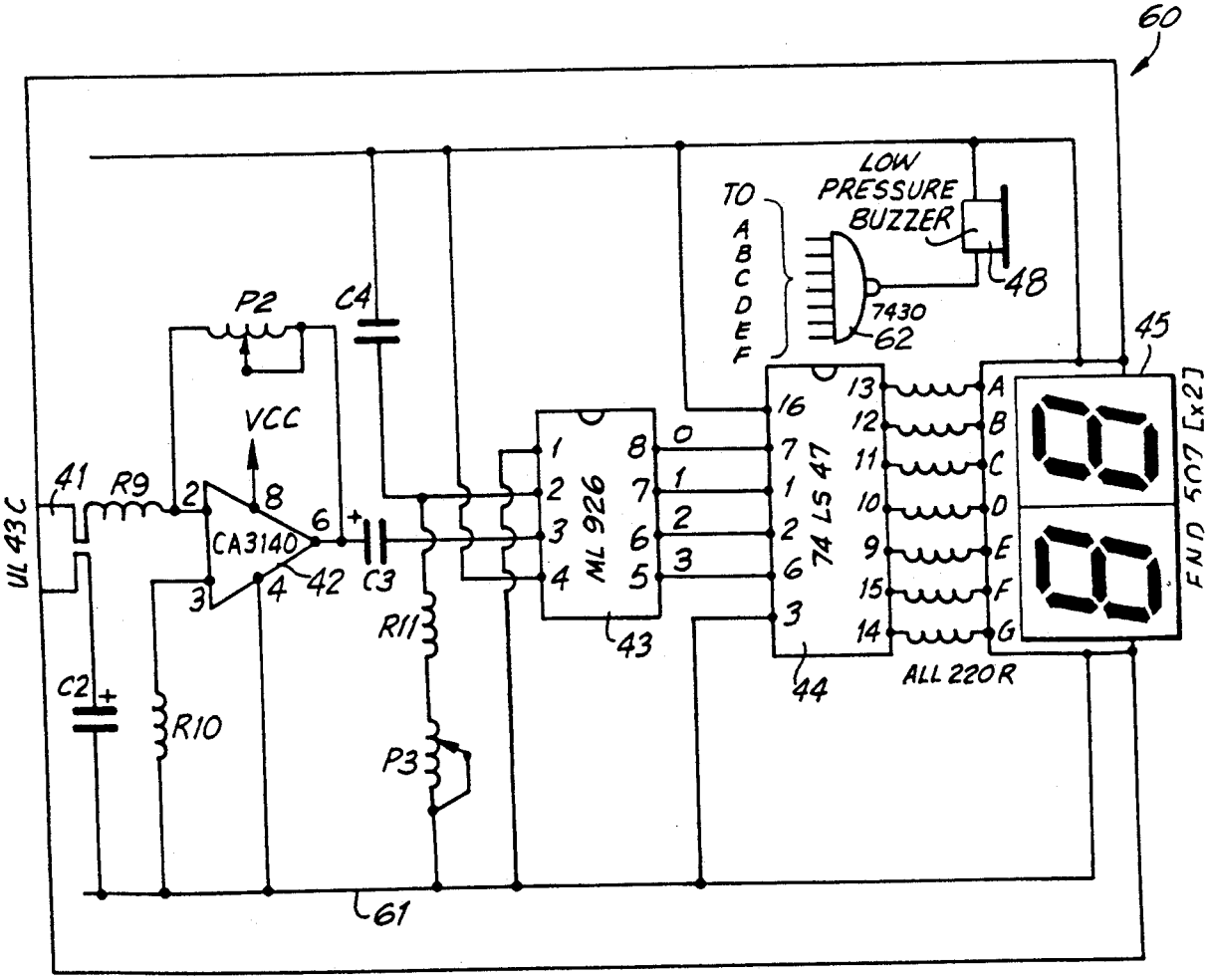
FIG. 5 is a detailed circuit diagram of part of the circuit of FIG. 2.

FIG. 5 is a detailed circuit diagram of a tank pressure receiver and indicator which forms part of the circuit of FIG. 2. The circuit 60 of FIG. 5 includes an ultrasonic receiver 41 which receives the ultrasonic signal produced by transducer 17 in FIG. 6. Amplifier 42 receives the output from receiver 41 via resistor R9. A filter capacitor C2 extends between receiver 41 and a reference or earth rail 61. Amplifier 42 has gain resistor R10 and P2 coupled to it. Resistor P2 is adjustable to enable the gain of amplifier 42 to be varied. The output from amplifier 42 is made available to decoder 43 via decoupling capacitor C. In this case, modulator decoder 43 is a remote control receiver device number ML926. Receiver 43 operates on a time scale fixed by an internal oscillator and external timing components C4, R11 and P3. The time constant provided by these timing components may be adjusted by resistor P3. Receiver 43 provides, at its four output terminals, mementary binary outputs. These binary outputs are coupled to display driver 44 which in this case is device number 74LS47. The output from driver 44 is used to provide a display of tank air pressure in display 45. The 7 outputs from driver 44 are also supplied to NAND gate 6 NAND gate 62 functions to provide a low logic output signal at a predetermined pressure of the tank and operates buzzer 48 when that low pressure is reached. This ensures that the circuit of FIG. 5 not only provides a visual indication of the actual tank pressure but also provides an audible signal once the tank pressure reaches a predetermined level.

Figure 7:
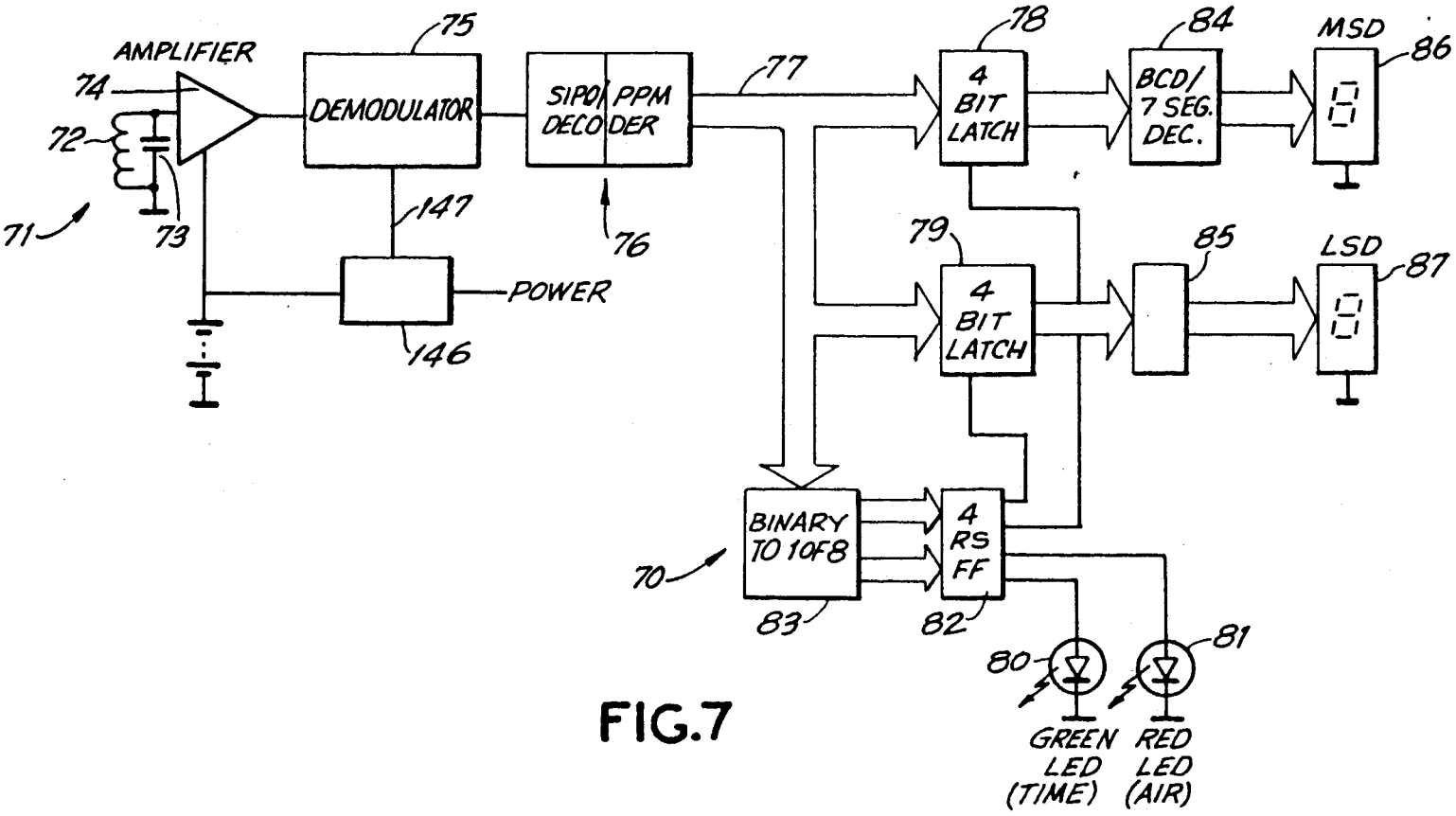
FIG. 7 is a block diagram of a display receiver circuit according to another embodiment of the invention.

The diagram of FIG. 7 shows a receiver circuit 70 in block diagram form. The circuit 70 is adapted for receiving radio frequency signals, preferably low radio frequency signals and has and an antenna 71 shown made up of a tank circuit having an inductor 72 and capacitor 73. The output derived from the antenna 71 is applied to an amplifier 74 of suitable gain. The output from the amplifier 74 is applied to a demodulator 75 and then to a decoder 76 which in this case is a serial in/parallel out pulse position modulator encoder. The signal derived from decoder 76 is supplied to bus 77 and thus to four bit latches 78, 79. In addition, the bus 77 also couples the output from the decoder to binary 1 of 8 decoder 83 to provide control signals for latches 78, 79 and to energize indicator light emitting diode (LED) displays 80, 81. Displays 80, 81 may be indicative of elapsed time and air remaining or of other parameters. For example, when neither is illuminated displays 86, 87 may set/reset flip flop 82 is coupled to the decoder 83 and it is flip flop 82 which controls latches 78, 79 as well LED's 80, 81. Decoders 84, 85 are BCD to seven segmanet decoders and drive displays 86, 87. Display 86 may display the most significant digit of two digits whilst display 87 displays the least significant digit of those two digits. Amplifer 74 and circuit 146 may be permanently powered and when a signal is received on control line 147 circuit 146 may then switch power to the remainer of the circuit.

Figure 8:
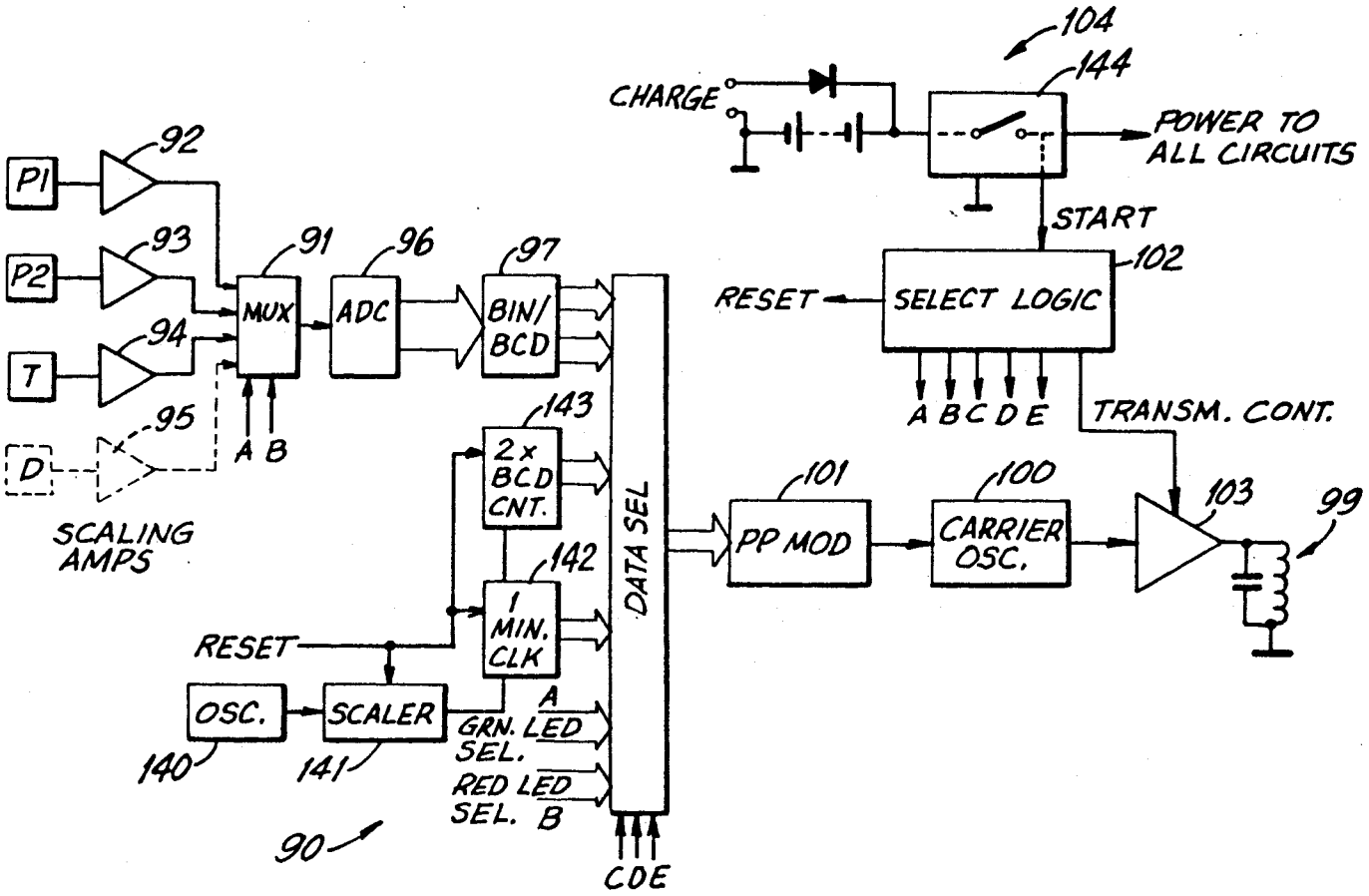
FIG. 8 is a block diagram of a transducer transmitter circuit according to another embodiment of the invention.

FIG. 8 shows a block diagram of a transducer transmitter circuit 90. In this diagram inputs P1, P2, T and D are shown. These inputs may be analog representations of parameters such as tank air pressure, external pressure or depth, temperature and any other parameter of interest to a diver. These inputs are applied to a multiplexer 91 via scaling amplifiers 92, 93, 94 and 95. An analog to digital converter (ADC) 96 converts the multiplexed signal into a digital signal for application to coder 97 which converts the digital signal to a binary coded decimal signal. Block 98 enables data to be selected whereby transmit antenna 99 may transmit rf signals indicative selectively of parameters P1, P2, T or D or of green or red LED energization signals to illuminate LED 80 or 81 (see FIG. 7).

The carrier oscillator 100 is modulated by a signal from modulator 101 which in this case is a pulse position modulator. Other forms of modulation may also be employed. Select logic circuit 102 provides selection signals A, B, C, D and E for controlling block 98 and also provides a transmit control signal for amplifier 103. The output from amplifier 103 is applied to antenna 99. A power supply circuit 104 is shown diagrammatically in FIG. 8. This circuit includes a water activated switch 144. FIG. 8 shows an oscillator 140, a scaling or counter circuit 141, a clock 142 and two BCD counters 143. These components produce dive time data.

FIG. 8 shows an embodiment obtained from discrete integrated circuits and components. It is also possible to implement the embodiment of FIG. 8 employing a micro processor or computer. Such an embodiment is illustrated in block diagram form in FIG. 9.

Figure 9:
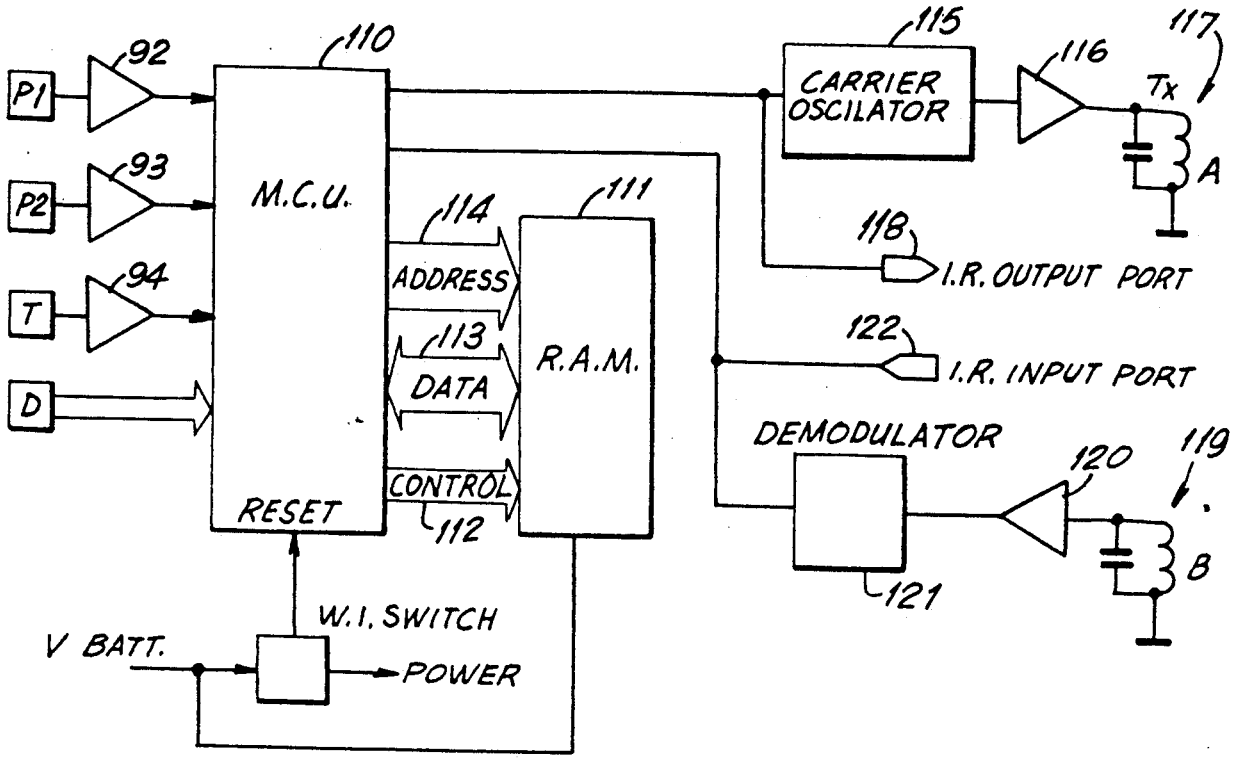
FIG. 9 is a block diagram of a transducer transmitter circuit according to another embodiment of the invention.

The transducer transmitter circuit of FIG. 9 has inputs P1, P2, T and D like that shown in FIG. 8. Inputs P1, P2 and T may be applied to microprocessor or computer 110 via scaling amplifiers. Computer 110 includes an analog to digital converter. The computer 110 has random access memory 111 coupled to it by control, address and data buses 112, 113, 114. The serial communication from computer 110 is applied to a carrier oscillator 115 amplifier 116, and transmitted by antenna 117 for reception by display receiver circuit like that of FIG. 7. The information from the computer may also be made available at output port 118. These ports may be infra red or optical ports.

The computer 110 has an input derived from receiving antenna 119 amplifier 120 and demodulator 121. Alternatively an input to the computer may be directly supplied via input port 122. The ports 122 and 118 allow for the preset of limits for the parameters so that warning indications (such as visual/or audible alarms) may alert the diver if a predetermined parameter is exceeded. The computer 110 may be programmed to enable interrogation of the parameters (by a dive master for example) by sending a signal to receiving antenna 119. The data stored in memory 111 may be logged over a real time base. Thus dives could be recalled as a record showing day, date and/or time. This data may be printed to provide a physical record.

Figure 10:
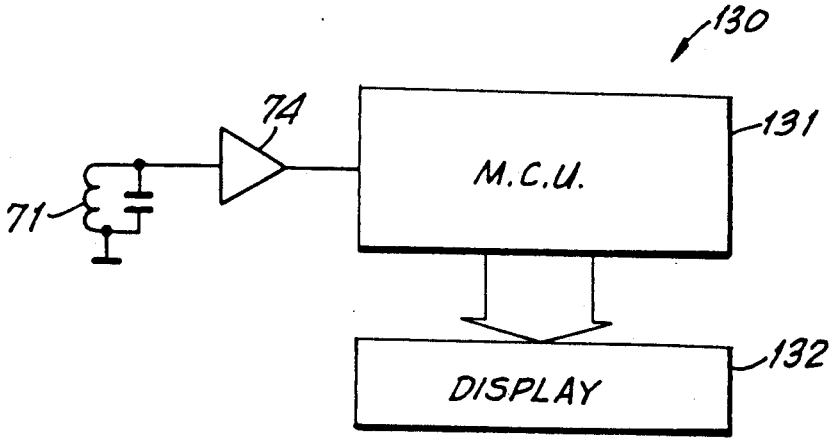
FIG. 10 is yet another embodiment of a display receiver circuit according to the invention; and, FIG. 11 is a detailed circuit diagram of the receiver circuit of FIG. 7.

The circuit of FIG. 10 is exemplary of a display receiver circuit. The circuit 130 differs from that shown in FIG. 7 in that discrete electronics has been implemented in a programmed microprocessor or computer 131. Receiving antenna 71 is coupled to amplifier much like that of FIG. 7 and amplifier 74 is coupled to computer 131 which processes the signal and provides outputs which may be applied to display 132. Of course driver circuits may be interposed between the computer 131 and display 132.

Figure 11:
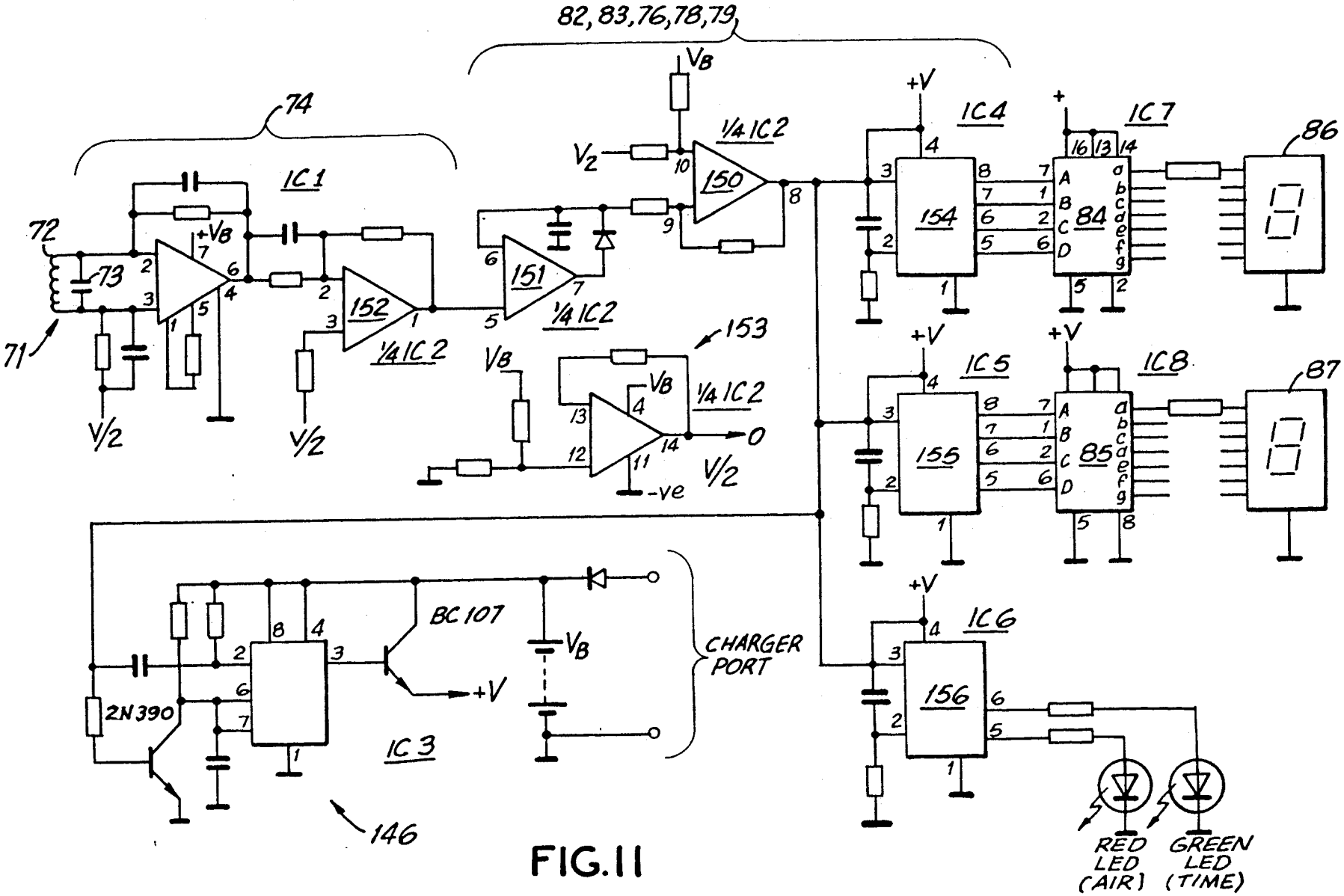

FIG. 11 is a detailed circuit diagram of the receiver circuit of FIG. 7. The antenna 71 is coupled to amplifier 74 which comprises two stages. The output from this two stage amplifier is coupled to component 151 which together with schmidt trigger 150 receiving integrated circuits 154, 155, 156 implement the funciton of blocks 76, 78, 79, 82 and 83 of FIG. 7.

Amplifier 153 which is one of four on a single integrated circuit receives the battery voltage VB and provides a zero reference voltage and a negative rail voltage whilst transistor BC107 provides a positive rail voltage. It is in this way that the supply for the integrated circuits of the circuit of FIG. 11 are powered. Device 146 a timer circuit for controlling devices 154.

The devices shown in the figure may be of the following type:

IC1 TCL271
IC2 TL064
IC3 ICM7555
IC4, 6 RS928
IC5 RS929
IC7, 8 MC14511

The invention enables dive parameters to be sensed and transmitted to a remote receiver. The display of the receiver may either be associated with a face mask or carried elsewhere by the diver without the need for a physical connection between the transmitter and receiver. In this way, the dive parameters are made available to the diver without the need for a cumbersome physical connection between, for example, the first stage of a regulator and a console carrying a display.

We claim:

1. An underwater transmitter/receiver assembly for use with a self-contained underwater breathing apparatus including a breathing gas tank and a diver's face mask, the assembly comprising:

transmitting circuit means attachable to said tank and including sensor means for providing output signals indicative of variable actual dive parameters, a modulator modulating said output signals, and a transmitting circuit propagating a modulated carrier wave representative of a respective one of said output signals;

means providing information on variable dive parameters to an individual diver wearing said face mask, said information providing means being attachable to the diver and including a receiver circuit which is physically disconnected from said transmitting circuit means and receives therefrom said modulated carrier wave, and a demodulator for demodulating said carrier wave; and a display device providing to the diver a visual display indicative of a respective variable dive parameter.

2. The assembly as claimed in claim 1, wherein said sensor means includes a pressure sensor providing an output signal indicative of gas pressure in said tank, said signal being modulated and propagated by the modulated carrier wave.

3. The assembly as claimed in claim 1, wherein said carrier wave is a low frequency radio wave.

4. The assembly as claimed in claim 2, wherein said transmitting circuit means includes a depth sensor providing an output signal indicative of the underwater depth of a diver, said output signal being also propagated by said modulated carrier wave, and said display device including means for providing a visual display indicative of said underwater depth.

5. The assembly as claimed in claim 2, and further comprising a depth sensor providing an output signal indicative of the underwater depth of a diver, and said display device including means for providing a visual display indicative of said underwater depth.

6. The assembly as claimed in claim 4, wherein said transmitting circuit means includes means for providing an output signal indicative of the elapsed dive time of a diver, said output signal being also propagated by said modulated carrier wave, and said display device including means for displaying a visual display indicative of said elapsed dive time.

7. The assembly as claimed in claim 5, wherein said information providing means includes means for providing an output signal indicative of elapsed dive time of a diver, and said display device including means for providing a visual display of said output signal.

8. The assembly as claimed in claim 2, wherein said display device includes light emitting diodes.

9. The assembly as claimed in claim 5, wherein said information providing means includes an alarm coupled to said receiver circuit to provide an audible signal when a predetermined depth is detected by said depth sensor.

10. The assembly as claimed in claim 5, wherein said information providing means includes alarms coupled to said receiver circuit to provide audible signals when a predetermined depth is detected by said depth sensor or when a predetermined tank pressure is detected by said pressure sensor.

11. The assembly as claimed in claim 2, wherein said display device includes liquid crystals.

12. The assembly as claimed in claim 1, wherein said display device is attached to the diver's mask.

13. The assembly as claimed in claim 1, wherein said display device is remote from the diver's face mask.

14. The device as claimed in claim 1, wherein said transmitting circuit means is attached to said tank.

15. The assembly as claimed in claim 1, wherein said display device is attached to the wrist of the diver.

16. The assembly as claimed in claim 1, wherein said display device is attached to the wrist of the diver.

17. An underwater transmitter/receiver assembly for use with a self-contained underwater breathing apparatus including a breathing gas tank and a diver's face mask, the assembly comprising:

transmitting circuit means attachable to said tank and including sensor means providing output signals indicative of variable actual dive parameters, a modulator modulating said output signals, and a transmitting circuit propagating a modulated carrier wave representative of a respective one of said output signals; and means for providing information on variable dive parameters to an individual diver, said information providing means being attachable to the diver and including a receiver circuit which is physically disconnected from said transmitting circuit means and receives therefrom said modulated carrier wave, a demodulator demodulating said carrier wave, a display device providing to the driver a visual display indicative of a respective variable dive parameter, and an imaging system providing an image of the display focussed in the line of sight of the diver, said imaging system being associated with said display device.

18. The assembly as claimed in claim 17, wherein said sensor means includes a pressure sensor providing an output signal indicative of gas pressure in said tank, said signal being modulated and propagated by the modulated carrier wave.

19. The assembly as claimed in claim 17, wherein said carrier wave is a low freqency radio wave.

20. The assembly as claimed in claim 18, wherein said transmission circuit means further includes a depth sensor providing an output signal indicative of the underwater depth of a diver, said output signal being also propagated by said modulated carrier wave, and said display device including means for providing a visual display indicative of said underwater depth.

21. The assembly as claimed in claim 18, and further including a depth sensor providing an output signal indicative of the underwater depth of a diver, and said display device including means for providing a visual display indicative of said underwater depth.

22. The assembly as claimed in claim 20, wherein said transmitting circuit means includes means for providing an output signal indicative of the elapsed dive time of a diver, said output signal being also propagated by said modulated carrier wave, and said display device including means for displaying a visual display indicative of said elapsed dive time.

23. The assembly as claimed in claim 17, further including means for providing an output signal indicative of elapsed dive time of a diver, and said display device including means for providing a visual display of said output signal.

24. The assembly as claimed in claim 18, wherein said display device includes light emitting diodes.

25. The assembly as claimed in claim 20, and further including an alarm coupled to said receiver circuit to provide an audible signal when a predetermined depth is detected by said depth sensor.

26. The assembly as claimed in claim 20, and further including alarms coupled to said receiver circuit to provide audible signals when a predetermined depth is detected by said depth sensor or when a predetermined tank pressure is detected by said pressure sensor.

27. The assembly as claimed in claim 17, wherein said display device is attached to the diver's face mask.

28. The assembly as claimed in claim 17, wherein said display device is remote from the diver's face mask.

29. The assembly as claimed in claim 18, wherein said display device includes liquid crystals.

* * * * *